US010392927B2

(12) United States Patent
Cherewyk

(10) Patent No.: US 10,392,927 B2
(45) Date of Patent: Aug. 27, 2019

(54) SYSTEM AND METHOD FOR DETECTION OF ACTUATOR LAUNCH IN WELLBORE OPERATIONS

(71) Applicant: ISOLATION EQUIPMENT SERVICES INC., Red Deer (CA)

(72) Inventor: Boris (Bruce) P. Cherewyk, Calgary (CA)

(73) Assignee: ISOLATION EQUIPMENT SERVICES INC., Calgary (CA)

( * ) Notice: Subject to any disclaimer, the term of this patent is extended or adjusted under 35 U.S.C. 154(b) by 0 days.

(21) Appl. No.: 15/638,027

(22) Filed: Jun. 29, 2017

(65) Prior Publication Data

US 2018/0003038 A1 Jan. 4, 2018

Related U.S. Application Data

(60) Provisional application No. 62/356,407, filed on Jun. 29, 2016.

(51) Int. Cl.

| | |
|---|---|
| ***E21B 10/32*** | (2006.01) |
| ***E21B 4/02*** | (2006.01) |
| ***E21B 43/112*** | (2006.01) |
| ***E21B 47/12*** | (2012.01) |
| *E21B 7/00* | (2006.01) |
| *E21B 29/00* | (2006.01) |
| *E21B 47/00* | (2012.01) |

(52) U.S. Cl.

CPC ..... *E21B 47/12* (2013.01); *E21B 4/02* (2013.01); *E21B 10/32* (2013.01); *E21B 43/112* (2013.01); *E21B 7/00* (2013.01); *E21B 29/00* (2013.01); *E21B 47/00* (2013.01)

(58) Field of Classification Search

CPC . E21B 47/12; E21B 47/00; E21B 4/02; E21B 10/32; E21B 43/112; E21B 7/00; E21B 29/00

See application file for complete search history.

(56) References Cited

U.S. PATENT DOCUMENTS 5,917,776 A * 6/1999 Foreman ..... H03K 17/94 340/568.1

2008/0217022 A1* 9/2008 Deans ..... E21B 47/12 166/338

(Continued)

*Primary Examiner* — David J Bagnell
*Assistant Examiner* — Yanick A Akaragwe
(74) *Attorney, Agent, or Firm* — Parlee McLaws LLP (CGY); Sean Goodwin

(57) ABSTRACT

A system and method are provided for confirming the launch of an actuator for delivery downhole into a wellbore for engagement with a downhole tool such as a packer, sliding sleeve and the like. A wellhead assembly has an axial wellbore in communication with the wellbore. An actuator launcher is located above the wellhead assembly for selectively releasing actuators into the axial wellbore. At least one waypoint is located in the axial bore. A detection device is mounted on the wellhead assembly capable of detecting receipt of a released actuator at the waypoint and generating a confirmation signal in response. A control system receives the confirmation signal, distinguishing between a successful launch and a non-successful launch of the actuator, and producing an output indicating whether introduction of the actuator was successful, the size and material of the actuator, and other pertinent information.

18 Claims, 7 Drawing Sheets

(56) References Cited

U.S. PATENT DOCUMENTS

| | | | | |
|---|---|---|---|---|
| 2010/0314097 | A1* | 12/2010 | Jennings | E21B 47/04 166/65.1 |
| 2012/0279717 | A1* | 11/2012 | Young | E21B 33/068 166/318 |
| 2014/0102717 | A1* | 4/2014 | Cherewyk | E21B 33/10 166/381 |
| 2016/0146962 | A1* | 5/2016 | Hayward | E21B 43/26 166/250.1 |

* cited by examiner

SYSTEM AND METHOD FOR DETECTION OF ACTUATOR LAUNCH IN WELLBORE OPERATIONS

CROSS-REFERENCE TO RELATED APPLICATIONS

This application claims the benefit of U.S. Provisional patent application Ser. No. 62/356,407, filed Jun. 29, 2016, the entirety of which is incorporated herein by reference.

FIELD

Embodiments disclosed herein generally relate to a method and apparatus for detecting the launch of actuators, such as drop balls, frac balls, packer balls, darts, sleeves, and other downhole valve actuation mechanisms, to be injected into a wellbore for interacting with downhole tools, and determining their size.

BACKGROUND

It is known to conduct fracturing or other stimulation procedures in a wellbore by isolating zones of interest or intervals within a zone) in the hydrocarbon-bearing locations of the wellbore, using packers and the like, and subjecting each isolated zone to treatment fluids, including liquids and gases, at treatment pressures. For example, in a typical fracturing procedure for a cased wellbore, the casing of the well is perforated or otherwise opened to admit oil and/or gas into the wellbore and fracturing fluid is then pumped into the wellbore and through the openings. Such treatment forms fractures and opens and/or enlarges drainage channels in the formation, enhancing the producing ability of the well. For open holes that are not cased, stimulation is carried out directly in the zones or zone intervals.

It is typically desired to stimulate multiple zones in a single stimulation treatment, typically using onsite stimulation fluid pumping equipment and a plurality of downhole tools, including packers and sliding sleeves, each of the packers located at intervals for isolating one zone from an adjacent zone. Sliding sleeves can be located between packers and are selectively actuable through introduction of an actuator into the wellbore to selectively engage one of the sleeves in order to block fluid flow thereby whilst opening the wellbore to the isolated zone uphole from the actuator for subsequent treatment or stimulation. Once the isolated zone has been stimulated, a subsequent ball is dropped to block off a subsequent sleeve, uphole of the previously blocked sleeve, for isolation and stimulation thereabove. The process is continued until all the desired zones have been stimulated. Typically, the actuators are balls that range in diameter from a smallest ball, suitable to travel past uphole sleeves to engage and block the most downhole sleeve, to the largest diameter, suitable for blocking the most uphole packer.

Once the isolated zone has been stimulated, a subsequent ball is dropped to block off a subsequent packer, uphole of the previously blocked packer, for isolation and stimulation thereabove. The process is continued until all the desired zones have been stimulated. Current methods and apparatus typically employ a launcher containing a plurality of actuators to be injected into the wellbore. In typical configurations, actuators are stored in a magazine or several magazines and, when injection of an actuator is desired, introduced into an axial bore axially aligned with the wellbore and pumped down with fracturing fluid.

Using actuator balls for example, while the launcher may have all the sizes of balls need for all the zones, a large and potentially expensive area of risk is the successful selection of the appropriate ball size, successful launch, and actual arrival of the ball at the downhole sleeve. While selection of the correct ball size is typically managed by proper surface procedures, e.g. ball size and launch indicators, an actuator may, once launched, fail to be successfully introduced into the wellbore. Such failures can be due to a variety of reasons, including the actuator becoming stuck in the launcher or the wellhead. The majority of instances where an actuator becomes stuck typically occur before the actuator reaches the wellbore, such as in equipment bores, including those of remote valves, blocks, wellhead components, or other components. For example, at low temperatures, an actuator can become stuck due to moisture in an auxiliary line, remote valve, actuator injector, or other components freezing and obstructing the movement of either the actuator or the mechanisms that move the actuator into the axial bore.

In typical treatment operations, successful transit of a dropped actuator, and actuation of a sleeve, packer, or other downhole tool, is confirmed by monitoring fluid pressure in the tubing string. A pressure spike is indicative of successful actuation by a dropped actuator. A lack of a pressure spike or a pressure spike of lower magnitude than expected is indicative of failed or partial engagement. The actuator can travel kilometers before reaching its target downhole tool. Confirming whether an actuator was successfully launched by waiting for a fluid pressure spike is inefficient, as it requires time and the unnecessary expenditure of fracturing or treatment fluid before failure or success can be determined. There is still a need to more expeditiously and reliably confirm successful actuator release to the wellbore.

SUMMARY

When injecting actuators, such as balls, during treatment operations using actuator injectors, it is advantageous to determine that an actuator was successfully launched from an actuator injector, through the wellhead components, and into the fluid stream pumped into the wellbore soon after a launch is initiated, thereby saving time and avoiding unnecessary expenditure of treatment fluids to obtain confirmation of successful actuation via a fluid pressure spike.

In one broad aspect, a system for confirming the launch of an actuator for delivery downhole into a wellbore, comprises: a wellhead assembly having an axial bore in communication with the wellbore below; a launcher above the wellhead for selectively releasing an actuator to the axial bore below; a waypoint in the axial bore; a detection device for generating confirmation signals related to receipt of a released actuator at the waypoint; and a control system for receiving the confirmation signals and distinguishing between a successful launch and a non-successful launch of the actuator.

In embodiments, the detection device is acoustically coupled to the waypoint directly or through the wellhead assembly.

In another embodiment, the waypoint can be a protrusion into the axial bore or a gate valve, and in another embodiment, the detection device is acoustically coupled to the gate.

In another embodiment, the waypoint comprises two or more waypoints spaced along the axial bore, each waypoint acoustically coupled to the detection device; and the control system receives the confirmation signals related to the two or more waypoints. The locational relationship of the two or more waypoints can be known and the control system compares the timing of the confirmation signals at each waypoint for confirmation of receipt of the actuator.

In another embodiment, the confirmation signal is an electric signal.

In another embodiment, the wellhead assembly further comprises at least a first gate valve located above a fracturing header; and the first gate valve forms the waypoint, and the detection device is in vibrational communication with a stem or gate of the first gate valve.

In another embodiment, a vibration conductor extends between the stem and the gate of the first gate valve.

In another embodiment, the detection device is a piezoceramic sensor or an ultrasonic sensor.

In another embodiment, the receipt of a released actuator at the waypoint creates vibrations, such as sound.

In one broad aspect, a method of confirming the launch of an actuator into a wellbore, comprises: introducing an actuator into the axial bore of a wellhead assembly in fluid communication with the wellbore; and detecting receipt of the actuator at a waypoint located in the axial bore.

In an embodiment, detecting receipt of the actuator at the waypoint further comprises detecting vibration at the waypoint.

In another embodiment, detecting vibration at the waypoint further comprises distinguishing said vibration from background vibration.

In another embodiment, the method of confirming the launch of an actuator further comprises: recording a first time of launch; recording a second time of detection of the vibration at the waypoint; and comparing the first and second times to distinguish successful launch of the actuator.

Confirmation of the introduction of an actuator into the wellbore also allows for more accurate estimation of when the actuator is expected to reach the intended downhole tool. Time accuracy is preferred so that the rate of fluid flow into the wellbore can be slowed just prior to the actuator engaging with the downhole tool, increasing the likelihood of successful engagement between the actuator and the downhole tool.

BRIEF DESCRIPTION OF THE DRAWINGS

FIG. 1A illustrates release of the actuator into the common axial bore, confirmation of receipt at a waypoint not yet detected.

FIG. 1B illustrates arrival of the actuator at a waypoint for receipt of confirmation thereat by the detection device, and FIG. 1C illustrates release of the actuator to the wellbore after confirmation of actuator release and arrival at the waypoint;

DETAILED DESCRIPTION OF THE EMBODIMENTS

Figure 1A:
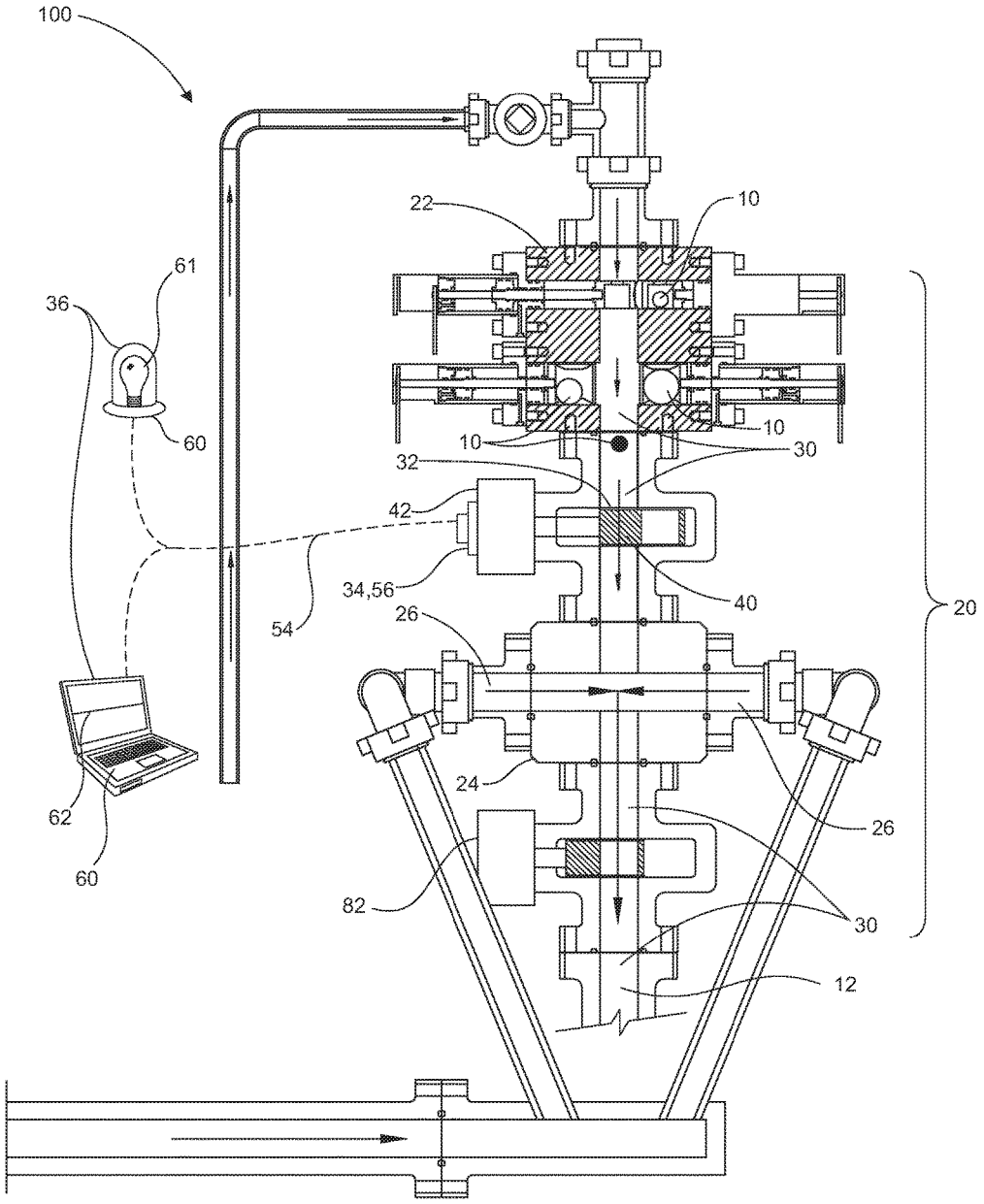
FIGS. 1A to 1C are cross-sectional representation of one embodiment of a fracturing system for deploying actuators downhole, depicting an actuator launcher, wellhead assembly including an actuator waypoint and a frac header therebelow, and a detection device connected to the fracturing system, a monitoring or control device connected being to the acoustic detection device for confirmation of launch, more particularly.

In embodiments described herein, a system and method is disclosed for detecting the successful introduction of an actuator 10, of a plurality of actuators, into a wellbore 12 for actuation of downhole tools such as valves. A wellhead assembly 20, comprising at least an actuator launcher 22 and a frac header 24 therebelow is secured to the wellbore 12 and having a common axial bore 30 therewith.

The axial bore 30 is fit with one or more actuator waypoints 32 and one or more detection and control devices 34,36 are connected to the system for confirmation of launch of an actuator.

Each detection device 34 is configured to detect arrival of the actuator 10 at the waypoint 32. While cooperative actuators 10 and waypoints 32 could be provided, such as RFID technology, typically the actuators are dumb, and herein, detection is based on one sided detection, such as vibrations generated by receipt of the actuator at the waypoint. The detectors 34 are mounted at suitable locations on a fracturing system to detect receipt of the actuator 10 such as through vibrations generated at the waypoint 32 and detected through a vibration or acoustic path from the waypoint 32 to a sensor of the detection device 34 for confirmation of receipt.

For example, an actuator 10 can be received at a waypoint 32 in the axial bore 30, which can be an obstruction such as a gate 40 of a closed gate valve 42. Vibrations from said receipt are transmitted to a detection device 34 in the gate 40, or through the gate valve 42 or wellhead assembly 20 to a detection device 34 remote from the waypoint 32. Similarly, as shown below (FIG. 2), a waypoint can be a protrusion 52 located in the common axial bore 30 of the fracturing system or within the wellbore 12.

Vibrations are converted by the detection device 34 for generation of confirmation signals 54, which can in turn be converted into a binary signal, for example "received" or "not received", or a time-based signal. The signal is indicative of whether an actuator 30 was successfully introduced into the wellbore. If confirmation signals are received, the operator can have a high expectation that the launch was successful.

Actuators 10 can be balls, darts, sleeves, and any other device known in the art for actuating downhole valves. References herein to balls, darts, sleeves, and similar devices refer to all such devices and variants known in the art. Vibrations can be physical vibrations, acoustic vibrations, or other vibrations suitable for determining whether an actuator has been introduced into the wellbore.

Figure 1B:
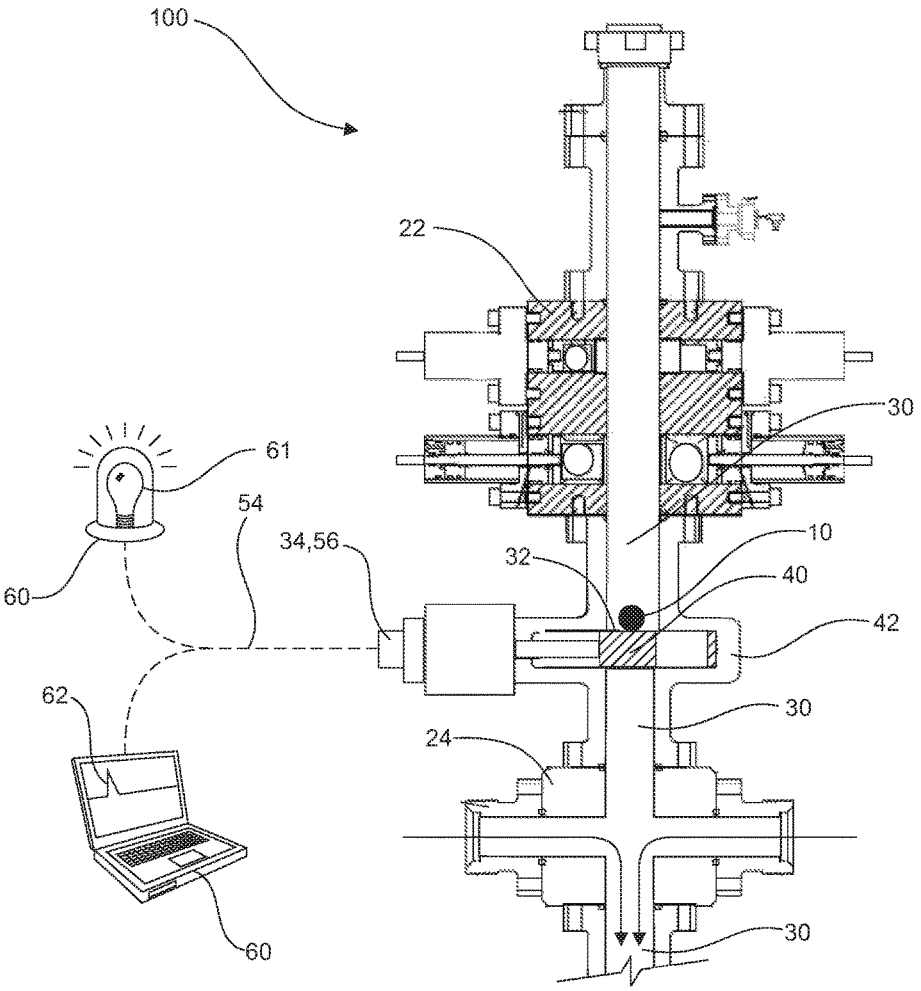
Figure 1C:
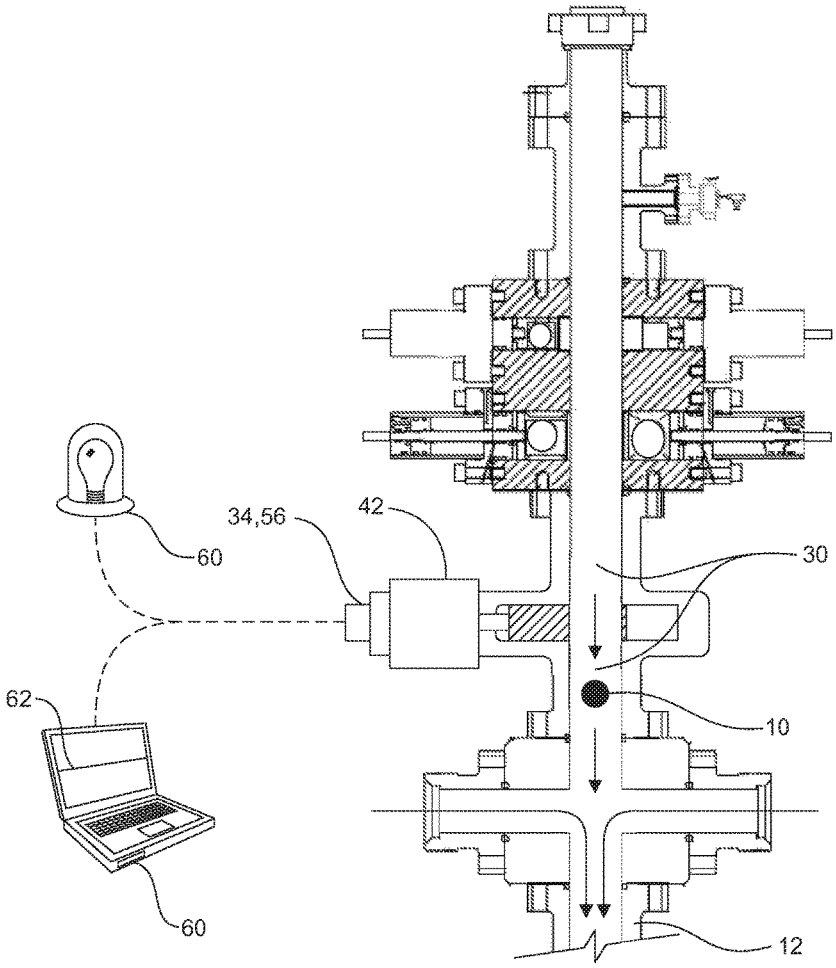
Figure 2:
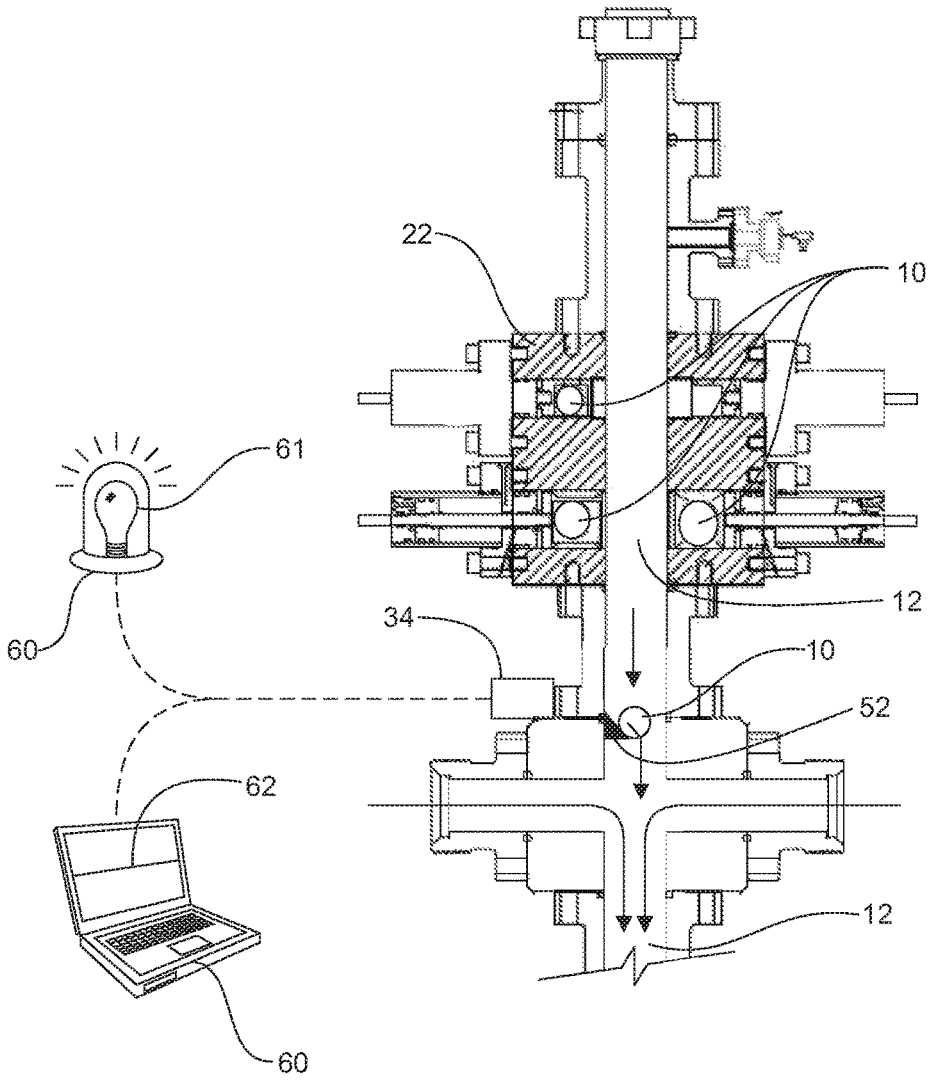
FIG. 2 is a cross-sectional representation of another embodiment of a fracturing system for deploying actuators depicting a launcher and an obstruction located in the common axial bore of the fracturing system for detection of passage thereby.

In an embodiment, as shown in FIGS. 1A to 2, wellhead/fracturing system 100 can comprise a fracturing header (frac header) 24 and an actuator launcher 22 located above, and connected to, the frac header 24. All the fracturing system components can have a common axial bore 30 and be fluidly connected to the wellbore 12 for launching actuators 10 into the wellbore 12 during fracturing operations. At least one actuator waypoint 32 can be located in the bore 30, such as the gate 40 of a gate valve 34.

The waypoint 32 is a feature in the wellhead assembly 20 that interacts with the actuator 10 as it moves through the connected bores from the launcher 22 and the balance of the wellhead assembly to the wellbore 12. The actuator 10 stops at or passes the waypoint 32, and its passage is noted. The detection of the actuator passage thereby is distinguishable over the background energy and matter, including the flow of fluids thereby, or elsewhere in the system. The detector 34 establishes signals 54 that meet a detection threshold or detection characteristic that can be isolated from non-actuator events including fluid flow, connected equipment vibration, and the like.

Each waypoint 32 is an identifying feature for actively and/or passively identifying the actuator 10 as it passes thereby. Examples of passive detectors include Hall effect sensors and electronically coupled identification (RFID). Active identification includes a transfer of energy by the actuator 10 moving through the bore and the components of the wellhead assembly, to the waypoint 32. Energy transfer can include contact between the actuator 10 and one or more components, including a stop, such as at a closed gate valve 42, or passing by a diverting projection or protrusion 52 in the axial bore 30. As shown in FIG. 2, one or more protrusions 52 can extend radially inwards from the wall of the bore 30, each protrusion shaped and sized to impinge on the path of actuator 10 as it passes thereby. Protrusions 52 do not stop the actuator 10.

Figure 3A:
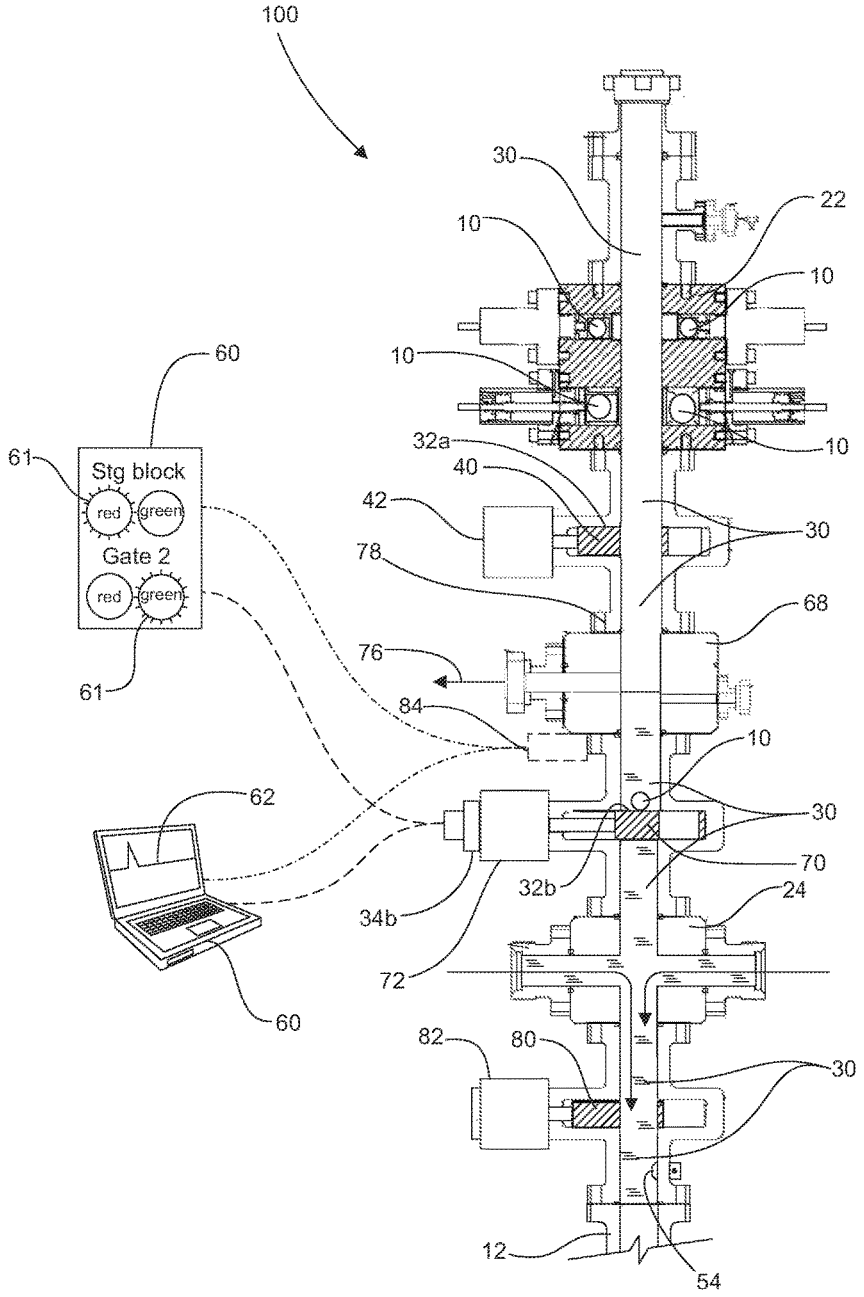
FIG. 3A is a cross-sectional representation of an embodiment of a staged fracturing system for deploying actuators, illustrating a wellhead assembly comprising a launcher, a launching block, a frac header, a wellhead for accessing a wellbore, gate valves for separately isolating each of the launching block and the frac header, and at least one detection device connected to the wellhead assembly.

Distinguishing actuator passage from the background energy or matter can be accomplished through a detection signal 54 greater than a threshold, or a pattern from two or more detection thresholds. A pattern could include two or more interactions of the actuator 10, or an event and an actuation interaction. For example, as shown in FIG. 3A in one embodiment, a control system 36 comprising one or more output devices 60 can be configured to process the signals from one more of detection devices 34 detecting the interaction of the actuator 10 with two or more axially spaced waypoints 32,32. Alternatively, a first time can be at the time of the signal to release an actuator 10, and a second time is at the time of detection of the actuator's passage at a waypoint 32 at a pre-determined time or delay. The time elapsed between the first time and second time can be analyzed. If the elapsed time is within an expected range, then the detected signal 54 can be considered as indicative of actuator receipt as opposed to background signal.

In embodiments, multiple detection devices 34 can be mounted at about the same axial location on the wellhead assembly 20 to provide a measure of redundancy. The multiple detection devices 34 can be the same or different types, for example an ultrasonic detection device and a vibrational knock sensor. The signals 54 generated by the axially coinciding detection devices 34 can also be used to distinguish vibrations generated by an actuator 10 interacting with waypoint 32 from background noise. For example, if a first detection device 34 detects a signal greater than a threshold, but a second detection device 34 does not, diagnostic processes can be performed on the signals detected by the detection devices 34,34 to determine whether the first detection device returned a false reading or if the second detection device is faulty.

Launcher 22 can be a component for manually introducing one actuator 10 at a time, such as a T-valve, or for storing a plurality of actuators 10, 10, 10 . . . and remotely and sequentially introducing the actuators 10 into the bore 30. Frac header 24 can have fluid inlets 26,26 for the introduction of fracturing fluid. The wellhead assembly 20 can include other equipment known in the art for providing safe and controlled access to the wellbore 12.

A detection device 34 can be connected to the fracturing system to detect vibrations generated by a dropped actuator 10 interacting with waypoint 32. Detection device 34 can comprise a transducer 56 or other component configured to detect the vibration caused by actuator 10 and generate an electrical confirmation signal 54 as a response. A transducer 56 can be incorporated into detection device 34 or be a discrete component connected to detection device 34 such as by a wire or through wireless communication. References herein to attaching detection device 34 to components refer to attaching the detection device 34 containing an integrated transducer 56 and/or attaching a discrete transducer 56 to said components. In embodiments, multiple detection devices 34 or transducers 56 can be mounted or embedded at various locations of the fracturing system 100.

The electrical confirmation signal 54 from detection device 34 can be converted by the detection device 34 or one or more output devices 60, which can comprise part of a control system 36, into an output 61,62, which can be analyzed to determine whether an actuator 10 has reached, interacted, or been received by, the waypoint 32. Output device 60 can be integral with detection device 34 or be a separate component. The output can be a simple binary indicator, such as a light 61 which illuminates when vibrations, generated from the actuator 10 impacting waypoint 32, exceed a threshold. The output can also be more complex, such as a time-based waveform 62, for example, indicating the amplitude of the detected vibration displayed on a monitor of output device 60. Amplitude and other more complex signal analysis can aid in distinguishing the event from background noise conducted to the detection devices, or information related to the actuator itself or its arrival. Waveforms or other outputs which provide information regarding the characteristics of the detected vibration can be further analyzed to provide information such as the size of the launched actuator, either in absolute terms or relative to a previously dropped actuator or a known reference waveform, as well as the weight, material, and other properties of the actuator detected. This can be useful to allow the operator to determine whether the correct actuator 10 was launched, for example in embodiments where multiple actuators 10,10 . . . are to be injected into the wellbore 12 in a sequence.

Such analyses can be performed by an operator or by a computing or control device 36, which can be integral with output device 60 or a discrete component.

Waypoints 32 can be located at a point in the axial bore 30 below launcher 22. Further, with reference to FIGS. 3A and 3B, detection devices 34 can be fit to any location on the fracturing system 100 where it is able to detect vibrations generated from actuator 10 striking waypoint 32 to determine successful introduction of an actuator 10. The form and position of each waypoint 32 is allocated to transmit a reliable, detectable vibration from the actuator 10 impacting obstruction 32 and for providing the operator with the confirmation and aiding in the decision process. For process management, it is useful for a waypoint 32 to be located immediately adjacent the frac header 24, as the receipt of the actuator 10 at waypoint 32 just before introduction into the fracturing fluid flow provides a reliable confirmation of successful launch downhole. Such a configuration reduces the number of potential locations between the waypoint 32 and wellbore 12 where the actuator 10 could subsequently become lodged or otherwise hung up after having already been detected by the detection device 34. The energetic flow environment of the frac header 24 ensures an actuator 10 entering the frac header 24 will flow into the wellbore 12 below. Additionally, such a configuration allows for more accurate estimation of when the actuator 10 is expected to reach the intended downhole tool, as it will be known at about what time the actuator 10 was confirmed to have been introduced into the fracturing fluid flow. Such time accuracy is preferred so that the rate of fluid flow into the wellbore can be slowed just prior to the actuator engaging with the downhole tool, increasing the likelihood of successful engagement between the actuator and the downhole tool.

In use, with reference to FIG. 1A, a selected actuator 10, to be introduced into the wellbore 12, can be launched into the bore 30 of the fracturing system 100 from launcher 22.

As shown in FIG. 1B, actuator 10 falls through bore 30 until it strikes waypoint 32, which in the depicted embodiment is the gate 40 of gate valve 42. The impact generates vibrations in gate valve 42 which are transmitted through components of the wellhead assembly 20 and are detected and converted to an electrical confirmation signal by detection device 34. Detection device 34 then sends the electrical signal 54 to output device 60 which converts the electrical signal to an output 61,62, which can be analyzed to determine whether the actuator 10 has successfully reached waypoint 32, and whether the correct actuator 10 was launched, as described above.

If the outputs 61,62 indicate that no significant vibration was detected after the launching of actuator 10, appropriate measures can be taken to determine the cause of the failure. If the outputs 61,62 confirm that there was a successful launch of actuator 10, then the operator could have a high confidence to move to the next actuator 10. The confirmation signal could also provide added information including whether the correct actuator 10 was launched into the bore 30.

As shown in FIG. 1C, the actuator 10, now confirmed as having been launched, can be allowed to proceed past waypoint obstruction 32 into the wellbore 12. In embodiments where waypoint 32 comprises one or more protrusions 52 or other components which do not stop the actuator from falling, such as the embodiment shown in FIG. 2, no further action needs to be taken after the successful launch of actuator 10 is confirmed by the output 60 as the actuator 10 continues downhole through the frac header 24 and into the wellbore 12.

In embodiments where waypoint 32 selectively blocks the bore 30, such as using a gate valve 42, the waypoint 32 can be actuated to open and allow the detected actuator 10 continue to fall into the wellbore 12.

In another embodiment, as shown in FIG. 3A, fracturing system 100 is configured to launch ball-type actuators 10 into the wellbore 12. The system comprises at least a frac header 24, a staging block 68, and a ball launcher 22, having common bore 30 and fluidly connected to a wellhead 12 for the launching of balls 30 into the wellbore 12 for fracturing operations. Isolation gate valves 42, 72, 82 can interconnect each of the frac header 24, staging block 68, launcher 22, and wellhead 12 and can selectively isolate each component from the others. In the depicted embodiment, gate valve #1 42 can interconnect the launcher 22 and the staging block 68, gate valve #2 72 can interconnect the staging block 68 and the frac header 24, and gate valve #3 82 can interconnect the frac header 24 and the wellhead 12. The wellhead assembly 20 typically includes other equipment for providing safe and controlled access to the wellbore 12.

The gate 70 of gate valve #2 72 functions as a waypoint 32*b*, that ball 10 impacts the gate 70 to generate a vibration to be detected by detection device 34*b*. Detection device 34*b* can be fit to gate valve #2 72 in a manner so as to enable detection of the impact of a launched ball 10 with the gate 70 of gate valve #2 72. As gate valve #2 72 is located immediately above frac header 24, successful receipt of the ball 10 at gate valve #2 72 predisposes a successful delivery to the wellbore, as the flow environment of the next component, the frac header 24, ensures a ball 10 entering the frac header 24 will flow into the wellbore 12 below. In an embodiment, detection device 34*b* can be connected to the fracturing system by fitting the detection device 34*b* to the stem or the body of gate valve #2 72 so as to detect and analyze vibrations emanating therefrom. Alternatively, detection device 34*b* can be fixed to a location in the proximity of the gate valve #2 72, so long as the detection device is capable of detecting vibrations generated at the gate valve #2 72.

With reference to FIG. 3A, at the start of ball launch operations, immediately before the launch of a ball 10, gate valve #1 42 is in the open position to permit communication between the launcher 22 and staging block 68, gate valve #2 72 is closed to prevent communication between staging block 68 and the frac head 24, and gate valve #3 82 is open to permit flow of treatment fluids into the wellbore 12. A ball 10 is introduced into the bore 30 from launcher 22 such that it travels downwards through the common axial bore 30 and lands onto gate valve #2 72. The vibrations from the impact are detected and converted to an electrical confirmation signal by detection device 34*b* and sent to output device 60, which translates the electrical signal into an output 61,62 and displays said output. Output 61,62 can comprise a light array 61, that illuminates a green light if vibrations generated by ball 10 striking gate valve #2 72 are detected, and continues to illuminate a red light otherwise.

Figure 3B:
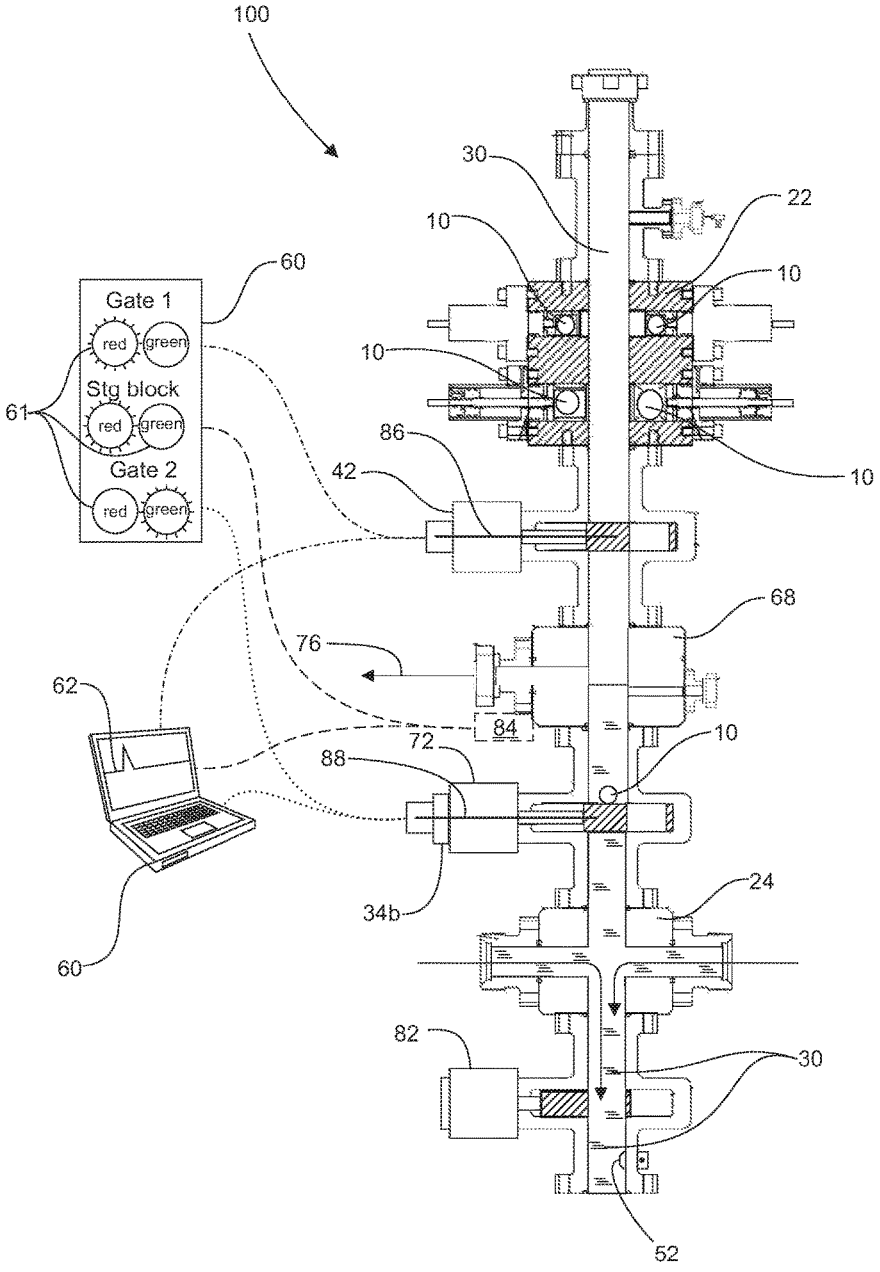
FIG. 3B is a cross-sectional representation of the wellhead assembly of FIG. 3A, comprising gate valve detection devices.

As shown in FIG. 3B, if the output 61,62 indicates that ball 10 was successfully dropped, the ball 10 can be introduced into the wellbore 12 by closing gate valve #1 42, pumping fluid into the staging block 68 to equalize pressure with the wellbore pressure, and opening gate valve #2 72 to allow fluid communication between the staging block 68 and wellbore 12. The fracturing system 100 is then reset for a subsequent ball launch by closing gate valve #2 72, pumping fluids out of the staging block 68 through fluid line 76, and opening gate valve #1 42. If the output 60 indicates that ball 10 was not successfully dropped, action can be taken to determine and correct the cause of the failure.

In an alternative embodiment, as shown in FIGS. 3A and 3B in dotted lines, detection device 84 can be connected to the body of the staging block 68, or a spool or neck of the flange 78 connecting gate valve #2 72 to the staging block 68. In such an embodiment, during treatment operations, the staging block 68 is filled with fluid, such as residual fluid from previous launch operations, from gate valve #2 72 up to at least a fluid line 76. The ball launch procedure is the same as above, and detection device 84 can detect acoustic vibrations transmitted at least in part through the fluid to determine whether a ball 10 has been successfully launched. Specifically, when ball 10 is dropped from the launcher 22 and lands on gate valve #2 72, the acoustic vibrations generated by the impact of the ball 10 on gate valve #2 72 propagate through the fluid in axial bore 30 above the gate valve 72 and the wall of the launch block 22, and is detected by detection device 84. As this embodiment also utilizes a liquid medium to aid vibration propagation, for the first ball launch, when the staging block 68 is typically free of fluid, fluid may be pumped into the staging block through fluid line 76 to fill the axial bore 30 above gate valve #2 72 up to about the height of the detection device 84.

Figure 4:
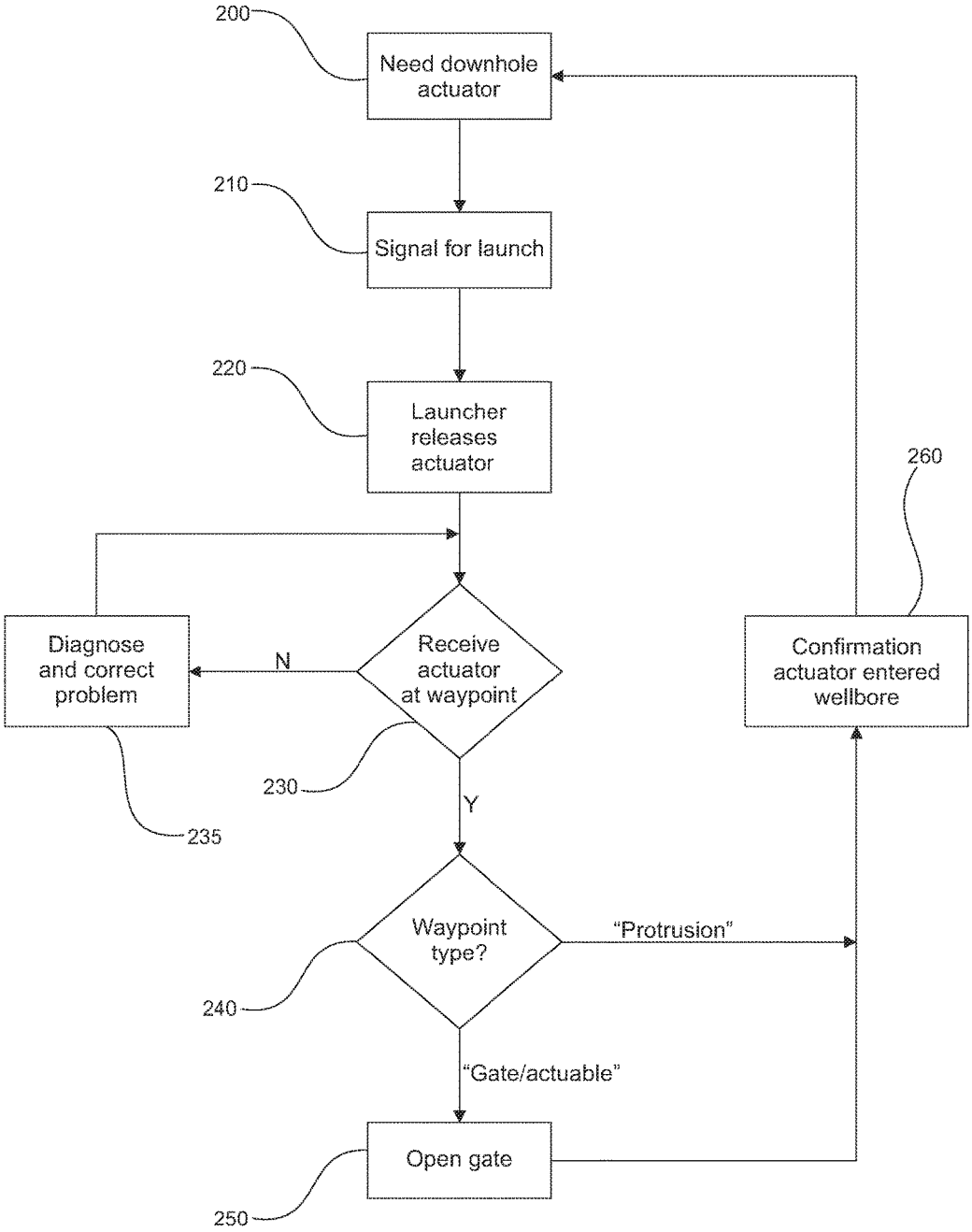
FIG. 4 is a flow chart depicting one embodiment of a procedure for confirming the introduction of an actuator into the wellbore.

One embodiment of the procedure for confirming the successful introduction of a downhole actuator 10 into the wellbore 12 is shown in FIG. 4. The process begins at 200 when it is determined that an actuator 10 is to be introduced into the wellbore 12. At 210, a signal for launch is sent to the launcher, such as a signal to an operator to manually launch an actuator 10, or an electrical signal where the actuator launcher 22 is remotely controlled. At 220, the launcher 22 releases the desired actuator 10 into the common bore 30 of the wellhead assembly 20. At 230, it is determined whether actuator 10 has been received at waypoint 32 using the detection methods described above. If no actuator 10 was received by waypoint 32, then the process proceeds to 235, wherein steps are taken to diagnose and correct the cause of the actuator injection failure. Once the problem has been corrected, the process returns once again to 230. If the actuator 10 has been received by waypoint 32, at 240 the process proceeds to 250 and opens the gate if waypoint 32 is a gate valve, and otherwise proceeds directly to 260 and confirms that an actuator 10 has entered wellbore 20. Once the injection of actuator 10 is confirmed, the process returns to 200 and a new actuator 10 can be injected.

The detection device 34 generally can be a vibrational sensor, for example a knock sensor for automobiles such as the KS4-P knock sensor by Bosch®, an ultrasonic detection device or sensor, such as the EPOCH 600 Nondestructive Testing device from Olympus Corporation®, or another type of suitable vibration detection device. Detection devices 34 vary in their abilities; some are designed for direct connection to a component to measured, and others are capable of measuring vibrations generated from a source at a distance. The use of an internal combustion engine knock sensor includes advantages for severe service including: pressure insensitivity for consistent results in a changing environment, excellent ambient noise cancellation for distinguishing background noises and reducing the incidence of false positives, excellent direct vibration contact and transmission and a wide range of operational temperatures. The Bosch® knock sensor is secured to the vibrating mass. Due to the inertia of the seismic mass, the sensor moves with the wellhead establishing a voltage signal via piezoceramic sensor element. Upper and lower voltage thresholds are related to an acceleration magnitude.

Detection device 34 may be mounted at a suitable location of the fracturing system 100 by securing the device 34 to a mounting point which will sufficiently conduct vibrations from waypoint 32 using bolts, straps, or other means of physical securement. The detection device 34 can be fit to a location proximate waypoint 32 and suitable for detecting vibrations generated by actuator 10 reaching, the obstruction 32.

As shown in FIG. 3B, detection device 34 can include sensor 86 and be directly mounted on, or incorporated into, the stem or gate of a gate valve, or a component of the fracturing system from which protrusion 52 extends into bore 30, thus providing a more direct acoustic path for measurement of vibrations. The detection device or control system can be configured to filter out other noises so that vibrations generated by the actuator 10 striking or otherwise arriving at the waypoint 32 are distinguishable. Such filtering can be done through hardware or software.

Additionally, interfaces between components can attenuate or otherwise distort vibrations detected by the detection device 34. For example, the interface between the stem and gate of a gate valve can attenuate vibrations as they travel from the gate, through the stem, to the detection device 34. Likewise, an interface between protrusion 52 and the housing of the component that the protrusion is formed, can attenuate vibrations. As an alternative to locating the detection device 34 closer to the waypoint 32, the vibrational conductive path can be improved, such as through insertion of a conductive rod, wire, or other vibration conductor 88, installed or run through between components, such as through the gate and stem of a gate valve, in order to provide a contiguous, direct path for vibrations to travel from the waypoint 32 to the detection device 34. Acoustic path improvement mitigates signal disruption due to the various surface interfaces, enhancing signal quality.

When detection device 34 is mounted on the exterior of a component of the fracturing system 100, vibrations may be less distinguishable than those detected by direct connection to waypoint 32. Detectors 34 mounted exterior to the bore 30 receive vibrations only after transmission through the fluids as well as the housing of the component before reaching the detection device 34. Accordingly, it is preferred to mount detection device 50 so that there is a direct connection to waypoint 32, either by mounting/embedding detection device 34 directly in the waypoint 32 or through a vibration conductor 88.

In embodiments, one or more gate valves 42, 72, 82 are equipped with sensors 86 coupled to the gate itself. In such cases, gate valve includes a flow body, a stem, a gate and a sensing bore. A bonnet is affixed to the flow body for securing the gate operably within. At least the stem, and optionally the gate, incorporate the sensing bore for receipt of the detector 34.

In an alternative embodiment, detector device 34 can be configured to detect the acoustic vibrations of an actuator 10 engaging with a downhole valve (not shown) in the wellbore. The magnitude of the receipt is necessarily greater due to the distance between the generation of the vibration and detection at the wellhead assembly. Actuation of the downhole tool can add to the energy for detection.

As will be appreciated by a person of skill in the art, the above are examples of particular embodiments of the system and method for detecting an actuator launch using a detection device. The method can be used in any system wherein actuators are introduced into wellbores, so long as there is a waypoint between the wellbore and the actuator source that an actuator can interact with, either passively or actively, and a detection device to identify said actuator interacting with said waypoint.

What is claimed is:

1. A method of confirming the launch of an actuator from a launcher for release of the actuator into a wellbore therebelow, comprising:

selectively blocking an axial bore at at least a first waypoint located between the launcher and the wellbore;

receiving the actuator in the axial bore below the launcher;

intercepting the actuator at the first waypoint, the interaction of the actuator and the first waypoint generating acoustic vibrations;

detecting the acoustic vibrations generated for confirming receipt of the actuator in the axial bore at the first waypoint; and upon confirmation of receipt, opening the axial bore at the first waypoint for release of the actuator into the wellbore;

wherein detecting the acoustic vibrations at the at least first wavy point further comprises distinguishing said acoustic vibrations from background vibration.

2. The method of claim 1 further comprising:

recording a first time of launch; and recording a second time of detection of the acoustic vibrations at the first waypoint; and comparing the first launch time and second detection time to a predetermined delay to distinguish receipt of the actuator in the axial bore below the launcher.

3. The method of claim 1, wherein detecting the acoustic vibrations further comprises:

generating confirmation signals related to the intercepting of the actuator at each of the at least first waypoint; and receiving the confirmation signals and distinguishing between a successful launch and a non-successful launch of the actuator.

4. The method of claim 3, further comprising receiving the confirmation signals at a control system.

5. The method of claim 4, wherein the at least a first waypoint is at least a first and a second waypoint, further comprising:

comparing a timing of receipt of the confirmation signals for each of the at least first and second waypoints and a locational relationship of the at least first and second waypoints for distinguishing between a successful launch and a non-successful launch of the actuator.

6. The method of claim 3, wherein generating the confirmation signal comprises generating an electric signal.

7. The method of claim 6, wherein generating the confirmation signals comprises generating electric signals from at least one piezoceramic sensor.

8. The method of claim 6, wherein generating the confirmation signals comprises generating electric signals from at least one ultrasonic sensor.

9. The method of claim 1, wherein the detecting the acoustic vibrations further comprises:

acoustically coupling the at least first waypoint to a wellhead assembly; and detecting the acoustic vibrations from the wellhead assembly.

10. The method of claim 1, wherein the intercepting of the actuator at the at least first waypoint comprises intercepting the actuator at a first gate valve blocking the axial bore.

11. The method of claim 10, wherein the detecting of the acoustic vibrations comprises detecting the acoustic vibrations from the first gate valve.

12. The method of claim 1, wherein the axial bore comprises first and second gate valves, the first gate valve being above the second gate valve, and:

the intercepting of the actuator at the first waypoint comprises selectively blocking the axial bore at the second gate valve and intercepting the actuator at the second gate valve;

the detecting of the acoustic vibrations further comprises detecting the acoustic vibrations from the receipt of the actuator at the second gate valve and then selectively blocking the axial bore above the first waypoint at the first gate valve; and the opening of the axial bore at the first waypoint comprises opening the second gate valve.

13. The method of claim 12, further comprising at least partially filling the axial bore, above the second gate valve, with fluid before intercepting the actuator at the second gate valve.

14. The method of claim 12, wherein the detecting of the acoustic vibrations further comprises generating waveforms from the acoustic vibrations.

15. The method of claim 14, further comprising analyzing the waveforms to determine a size of the actuator.

16. The method of claim 15, further comprising determining the size of the actuator by comparing the waveform to a reference waveform.

17. The method of claim 14, further comprising analyzing the waveforms to distinguish the acoustic vibrations from background vibration.

18. The method of claim 1, wherein the intercepting the actuator at the at least first waypoint along the axial bore is performed while the axial bore is at least partially filled with fluid.

* * * * *